US009697727B2

(12) United States Patent
Chen et al.

(10) Patent No.: US 9,697,727 B2
(45) Date of Patent: Jul. 4, 2017

(54) REMOTE CONTROL APPARATUS

(71) Applicant: QBLINKS INCORPORATED, Taipei (TW)

(72) Inventors: Shao-Chun Chen, Hualien (TW); Li-Ming Huang, Taipei (TW)

(73) Assignee: QBLINKS INCORPORATED, Taipei (TW)

( * ) Notice: Subject to any disclaimer, the term of this patent is extended or adjusted under 35 U.S.C. 154(b) by 97 days.

(21) Appl. No.: 14/849,989

(22) Filed: Sep. 10, 2015

(65) Prior Publication Data

US 2017/0076590 A1 Mar. 16, 2017

(51) Int. Cl.
*G08C 19/00* (2006.01)
*G08C 17/02* (2006.01)

(52) U.S. Cl.
CPC ..... *G08C 17/02* (2013.01); *G08C 2201/30* (2013.01); *G08C 2201/60* (2013.01)

(58) Field of Classification Search
CPC .... G08C 17/02; G08C 17/00; G07C 9/00182; G07C 2009/00793; A63H 30/04
USPC ..... 340/12.5
See application file for complete search history.

(56) References Cited

U.S. PATENT DOCUMENTS 8,150,387 B2 * 4/2012 Klein ..... H04M 1/72533 348/734
2008/0301729 A1 * 12/2008 Broos ..... H03J 1/0025 725/38
2011/0294490 A1 * 12/2011 Faenger ..... G08C 17/00 455/419
2014/0267932 A1 * 9/2014 Riddell ..... H04N 5/4403 348/734

* cited by examiner

*Primary Examiner* — Yong Hang Jiang
(74) *Attorney, Agent, or Firm* — Muncy, Geissler, Olds & Lowe, P.C.

(57) ABSTRACT

A remote control apparatus wirelessly connected with a host apparatus comprises a wireless transmission unit, a control unit and an operation unit. The wireless transmission unit is wirelessly connected with the host apparatus. The control unit is electrically connected with the wireless transmission unit and the operation unit. The host apparatus is configured with an integration application unit, and the control unit authenticates the integration application unit and acquires a permission for operating at least one function of an operation system of the host apparatus. The operation unit can receive an operation mode, and the control unit generates a control signal according to the operation mode. The control unit transmits the control signal to the host apparatus through the wireless transmission unit for choosing one of the operation system and the integration application unit to trigger at least one event according to the control signal.

14 Claims, 5 Drawing Sheets

REMOTE CONTROL APPARATUS

BACKGROUND OF THE INVENTION

Field of Invention

This invention relates to a remote control apparatus and, in particular, to a remove control apparatus which can control a host apparatus to perform a predetermined procedure.

Related Art

Due to the progress of the mobile communication technology and the development of the semiconductor technology, the smart mobile apparatuses, such as smart phones and tablet computers, have more and more powerful functions. The user can install various application programs on the smart mobile apparatuses. In the usage, when the user wants to start some application program, the user needs to find the application program on the displayed image and then click the icon of the application program. However, in some situations, such operation will trouble the user.

For example, when the user wants to start the navigation program during the driving, the above-mentioned operation manner, which belongs to a conventional type, will very likely cause a car accident and the property or body damage.

Moreover, the technology of Internet of Things (IoT) has a great progress recently, so that the smart appliance and the cloud computing and control have become a very important civil technology for the next century. At present, a conventional way to control the smart appliance needs to be performed by the above-mentioned smart mobile apparatus. Therefore, the user also needs to use the above-mentioned operation manner or even a more complicated manner to control the smart appliance by the smart mobile apparatus.

Therefore, it is an important subject to provide a simple method of operating the smart mobile apparatus and the smart appliance.

SUMMARY OF THE INVENTION

In view of the foregoing subject, an objective of the invention is to provide a remove control apparatus and a control system which can provide a simple operation mode for the user to operate a mobile apparatus and a smart appliance.

To achieve the above objective, a remote control apparatus of this invention is wirelessly connected with a host apparatus and comprises a wireless transmission unit, a control unit and an operation unit. The wireless transmission unit is wirelessly connected with the host apparatus. The control unit is electrically connected with the wireless transmission unit. The host apparatus is configured with an integration application unit, and the control unit authenticates the integration application unit and acquires a permission for operating at least one function of an operation system of the host apparatus. The operation unit is electrically connected with the control unit and receives an operation mode, and the control unit generates a control signal according to the operation mode. The control unit transmits the control signal to the host apparatus through the wireless transmission unit for choosing one of the operation system and the integration application unit to trigger at least one event according to the control signal.

In one embodiment, the remote control apparatus further comprises a storage unit. The storage unit is electrically connected with the control unit and pre-stores a first corresponding table. The control unit generates the control signal according to the operation mode and the first corresponding table to control at least one function of the operation system.

In one embodiment, the storage unit further comprises a second corresponding table, which can be set by a user, the control unit generates the control signal according to the operation mode and the second corresponding table to control the at least one function of the operation system.

In one embodiment, the remote control apparatus further comprises a storage unit. The storage unit is electrically connected with the control unit and stores a result of the authentication performed by the control unit to the integration application unit.

In one embodiment, the storage unit further comprises at least one integration application corresponding table, which corresponds to the integration application unit and is stored in the integration application unit, the control unit of the remote control apparatus authenticates the integration application unit and transmits the control signal to the host apparatus, and the integration application unit operates at least one function according to the control signal.

In one embodiment, triggering the at least one event comprises starting the function of the operation system of the host apparatus, calling an application program installed on the host apparatus, calling the application program to remotely control at least one remote electronic apparatus, calling the application program installed on the remote electronic apparatus to control the at least one remote electronic apparatus, or transmitting the control signal to a remote server and then making the at least one remote electronic apparatus connected with the remote server to acquire the control signal and execute a corresponding operation.

In one embodiment, the operation unit is at least one of a button, a gesture sensor, an infrared sensor, a temperature sensor, an ultraviolet sensor and a touch sensor.

In one embodiment, the operation mode comprises a number of clicks, a short pressing, a long pressing, the combination of a short pressing and a long pressing, a click number, a click frequency, a duration of a continuous click, the combination of a long click and a short click, a gesture, a single-finger sliding, a multi-finger sliding or a direction of a sliding.

In one embodiment, the wireless transmission unit is a Bluetooth transmission unit, a Bluetooth low energy transmission unit, a Zigbee transmission unit or an IPv6 over Low power WPAN (6LoWPAN) transmission unit.

In one embodiment, the storage unit further comprises a scenario parameter table, and the remote control apparatus adjusts its action mode according to the scenario parameter table.

To achieve the above objective, a remote control apparatus of this invention is wirelessly connected with a host apparatus and comprises a wireless transmission unit, a control unit, an operation unit and a storage unit. The wireless transmission unit is wirelessly connected with the host apparatus. The control unit electrically connected with the wireless transmission unit and acquires a permission for operating at least one function of an operation system of the host apparatus. The operation unit is electrically connected with the control unit and receives an operation mode. The control unit generates a control signal according to the operation mode. The storage unit is electrically connected with the control unit and pre-stores a first corresponding table. The control unit transmits the control signal to the host apparatus according to the first corresponding table through the wireless transmission unit to operate at least one function.

In one embodiment, the first corresponding table is a predetermined corresponding table, and the control unit generates the control signal according to the operation mode and the first corresponding table to control at least one function of the operation system.

In one embodiment, the storage unit further comprises a second corresponding table, which can be set by a user, the control unit generates the control signal according to the operation mode and the second corresponding table to control at least one function of the operation system.

In one embodiment, the host apparatus is configured with an integration application unit, the storage unit further comprises at least one integration application corresponding table, which corresponds to the integration application unit and is stored in the integration application unit, the control unit of the remote control apparatus authenticates the integration application unit and transmits the control signal to the host apparatus, and the integration application unit operates at least one function according to the control signal.

In one embodiment, operating the at least one function comprises starting the function of the operation system of the host apparatus, calling an application program installed on the host apparatus, calling the application program to remotely control at least one remote electronic apparatus, calling the application program installed on the remote electronic apparatus to control the at least one remote electronic apparatus, or transmitting the control signal to a remote server and then making the at least one remote electronic apparatus connected with the remote server to acquire the control signal and execute a corresponding operation.

In one embodiment, operating the at least one function comprises starting the function of the operation system of the host apparatus, calling an application program installed on the host apparatus, calling the application program to remotely control at least one remote electronic apparatus, calling the application program installed on the remote electronic apparatus to control the at least one remote electronic apparatus, or transmitting the control signal to a remote server and then making the at least one remote electronic apparatus connected with the remote server to acquire the control signal and execute a corresponding operation.

In one embodiment, the operation unit is at least one of a button, a gesture sensor, an infrared sensor, a temperature sensor, an ultraviolet sensor and a touch sensor.

In one embodiment, the operation mode comprises a number of clicks, a short pressing, a long pressing, the combination of a short pressing and a long pressing, a click number, a click frequency, a duration of a continuous click, the combination of a long click and a short click, a gesture, a single-finger sliding, a multi-finger sliding or a direction of a sliding.

In one embodiment, the wireless transmission unit is a Bluetooth transmission unit, a Bluetooth low energy transmission unit, a Zigbee transmission unit or an IPv6 over Low power WPAN (6LoWPAN) transmission unit.

In one embodiment, the storage unit further comprises a scenario parameter table, and the remote control apparatus adjusts its action mode according to the scenario parameter table.

Because the remote control apparatus provided by this invention can acquire the permission for operating at least one function of the operation system of the host apparatus and can perform the authentication with the integration application unit, the remote control apparatus of this invention can provide the operation mode whereby the user can simply operate the host apparatus and the smart appliance.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
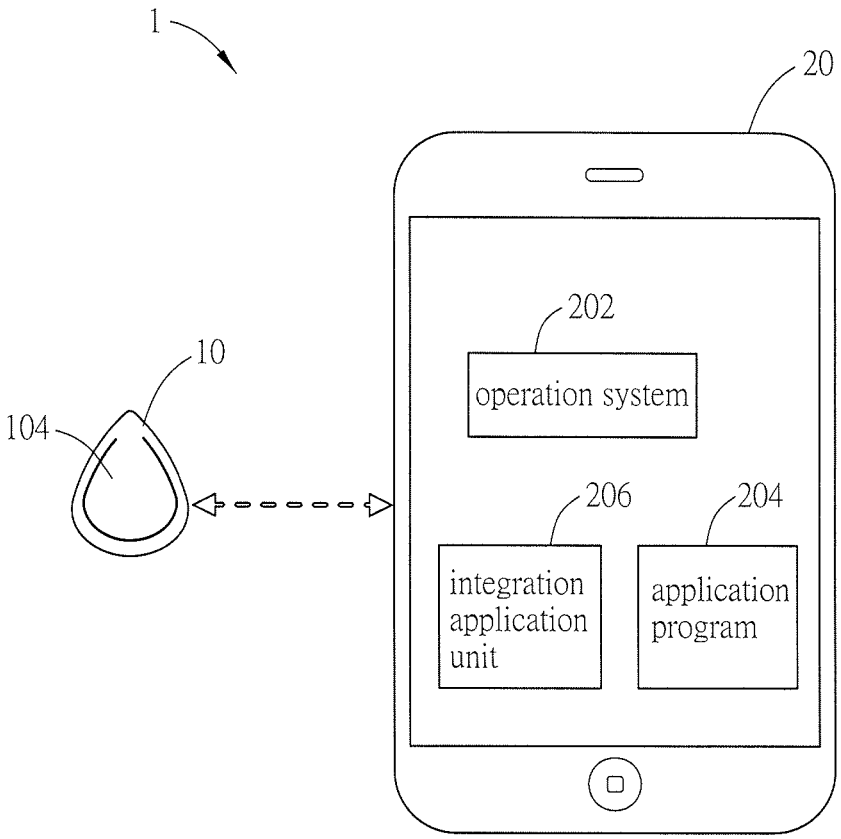
FIG. 1 is a schematic diagram of a control system of the first embodiment of the invention.

FIG. 1 is a schematic diagram of a control system of the first embodiment of the invention. As shown in FIG. 1, the control system 1 provided by this embodiment includes a remote control apparatus 10 and a host apparatus 20. The host apparatus 20 can be a smart mobile phone, a tablet computer, a notebook computer, a tablet notebook computer, a wallet computer, a desktop computer or an industrial computer. The host apparatus 20 is a smart mobile phone in this embodiment. The remote control apparatus 10 can be connected with the host apparatus 20.

In this embodiment, the host apparatus 20 is configured with an operation system 202 and suitable to be configured with at least one application program, such as the application program 204. Besides, the host apparatus 20 is also configured with an integration application unit 206, which can be implemented by software, firmware or even hardware. In the following embodiments, the integration application unit 206 is installed on the host apparatus 20 in the form of software.

In a favorable embodiment, the remote control apparatus 10 has a size about larger than the fingertip of a thumb and can be designed as a pendant of a necklace or a phone accessory for the portability.

Figure 2:
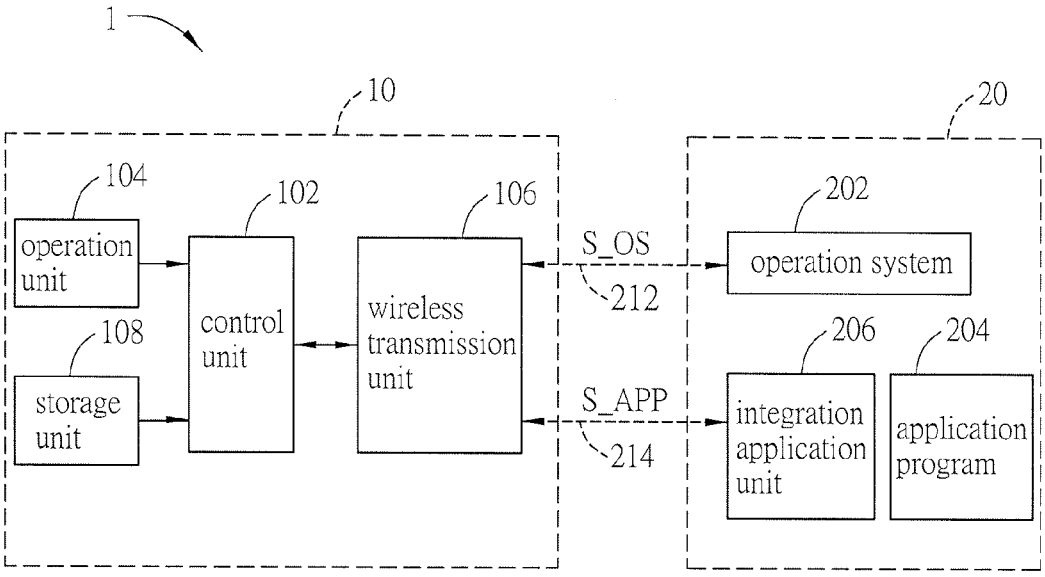
FIG. 2 is a schematic block diagram of the control system of the first embodiment of the invention.

FIG. 2 is a schematic block diagram of the control system of the first embodiment of the invention. As shown in FIG. 2, the remote control apparatus 10 includes a control unit 102, an operation unit 104 and a wireless transmission unit 106. The control unit 102 can be a microcontroller, a single chip, an embedded controller or a microprocessor and can be electrically connected with the operation unit 104 and the wireless transmission unit 106. Herein, the above-mentioned "electrically connected with" can be achieved through a wire, or a metal pattern on a circuit board, or a conductor, or some passive components, such as resistors, capacitors or inductors, and these descriptions will be omitted below for conciseness.

The operation unit 104 can be a button, an action sensing unit, an infrared sensing unit, a touch unit, a pressure sensing unit, a temperature sensor, an ultraviolet sensor or the like. The wireless transmission unit 106 can be a Bluetooth transmission unit, a Bluetooth low energy transmission unit, a Zigbee transmission unit or an IPv6 over Low power WPAN (6LoWPAN) transmission unit, and the 6LoWPAN conforms to the wireless transmission protocol of the IEEE 802.15.4 standard. However, this invention is not limited thereto. The wireless transmission unit 106 is connected to the host apparatus 20 by at least one wireless transmission protocol, such as the generic attribute profile (GATT). Besides, in the wireless transmission protocol, it is permitted that the designer can adjust to obtain the optimum parameters corresponding to different scenarios. For the Bluetooth as an example, the parameters including advertising interval, Interval Max, Interval Min, Slave Latency and Connection Supervision Timeout can be adjusted by the designer.

In detail, when the remote control apparatus 10 needs to be connected with the host apparatus 20, the wireless transmission unit 106 will build an operation system connection 212 with the operation system 202, so that the control unit 102 will obtain the permission for operating at least one function of the operation system 202. Then, the control unit 102 will query the operation system 202, through the operation system connection 212, if the host apparatus 20 is configured with the integration application unit 206. Meanwhile, the integration application unit 206 will perform an authentication procedure through the wireless transmission unit 106. From another point of view, the control unit 102 will perform the authentication with the integration application unit 206. After the authentication is completed, the control unit 102 will regard the host apparatus 20 as an authentication host apparatus and the wireless transmission unit 106 can build an application connection 214 with the integration application unit 206.

In this embodiment, the remote control apparatus 10 can further include a storage unit 108. After the above-mentioned authentication procedure is completed, the control unit 102 can store the authentication result (ex. the identification code of the host apparatus 20) in the storage unit 108. As a result, when the remote control apparatus 10 needs to be connected with the host apparatus 20 next time, the authentication procedure can be omitted. The storage unit 108 can be a flash memory, a memory card, an optical storage medium, a hard disk, a solid state disk (SSD) or the like.

As shown in FIGS. 1 and 2, after the remote control apparatus 10 obtains the pet mission for operating a function of the operation system 202 of the host apparatus 20 and performs the authentication with the integration application unit 206, the control unit 102 can transmit a control signal to the host apparatus 20 through the wireless transmission unit 106 according to the operation mode received by the operation unit 104 for choosing the operation system 202 or the integration application unit 206 to trigger a corresponding event. In this embodiment, the operation unit 104 can be a button. Accordingly, the above-mentioned operation mode can refer to how many times the user presses the operation unit 104 or the mode of pressing the operation unit 104, such as a short pressing, a long pressing, the combination of a short pressing and a long pressing or a continuous pressing. To be noted, with different types of the operation unit 104, the above-mentioned operation mode can refer to the click number, the click frequency, the duration of a continuous click, the combination of a long click and a short click, the gesture, a single-finger sliding, a multi-finger sliding or the direction of a sliding. The above-mentioned multi-finger sliding refers to the operation of using two or more fingers to slide on the operation unit 104. Some cases are illustrated as below to describe how the control unit 102 triggers the corresponding event according to different operation modes received by the operation unit 104.

For example, the mode of continuously pressing the operation unit 104 is set to start a function of the operation system 202 of the host apparatus 20. Accordingly, when the control unit 102 determines that the operation unit 104 is continuously pressed, the control unit 102 can transmit an operation system control signal S_OS through the wireless transmission unit 106 and then the operation system control signal S_OS can be transmitted to the host apparatus 20 through the operation system connection 212.

When the operation system 202 of the host apparatus 20 receives the operation system control signal S_OS through the operation system connection 212, the operation system 202 can decode the operation system control signal S_OS and start the corresponding function, such as the Siri of the iOS, according to the decoded content.

In another case where the mode of shortly pressing the operation unit 104 for one time is set to start the application program 204, when the control unit 102 determines that the operation unit 104 is shortly pressed for one time, the control unit 102 can transmit an application control signal S_APP through the wireless transmission unit 106 and the application control signal S_APP will be transmitted to the host apparatus 20 through the application connection 214.

When the host apparatus 20 receives the application control signal S_APP through the application connection 214, the integration application unit 206 will decode the application control signal S_APP and then start the application program 204 according to the application control signal S_APP.

In some scenarios, it is supposed that the application program 204 is a navigation program and the user wants to start this navigation program during the driving. Accordingly, in this invention, the user can start the navigation program just by shortly pressing the operation unit 104 of the remote control unit 10 for one time instead of performing a complicated operation. Therefore, the safety of the driving can be greatly improved.

In this embodiment, the user can set different operation modes to correspond to different events through the integration application unit 206. In an embodiment, the remote control apparatus 10 can be connected with different host apparatuses 20, and can trigger different events for the different host apparatuses 20 according to the user's setting when the operation unit 104 receives the same operation mode. For example, when the user shortly presses the operation unit 104 for one time, the remote control apparatus 10 can make one of the host apparatuses 20 start the application program and may also make another host apparatus 20 start one function of the operation system 202. Hence, when the user performs the setting of the remote control apparatus 10 through the integration application unit 206, the user's setting can be stored in at least one integration application corresponding table of the storage unit 108, the integration application unit 206 will also keep the integration application corresponding table, and the control unit 102 will look up the integration application corresponding table according to the operation mode received by the operation unit 104 to generate the above-mentioned application control signal S_APP or the operation system control signal S_OS. Therefore, the user can use the remote control apparatus 10 to control the multiple host apparatuses 20. The integration application corresponding table corresponds to the user's setting of the integration application unit 206 of the host apparatus 20, but the user also can perform the setting of the remote control apparatus 10 through the integration application unit 206 of another host apparatus 20 and the remote control apparatus 10 will store the setting made by the user for another host apparatus 20 as another integration application corresponding table. Accordingly, the user can use the different integration applications corresponding tables stored in the remote control apparatus 10 to operate the different host apparatuses 20.

The storage unit 108 of the remote control apparatus 10 further includes a scenario parameter table. The scenario parameter table includes at least a group of scenario parameter. The scenario parameters refer to various parameters for the connections with different host apparatuses 20 and for the different scenarios (for example, the remote control apparatus 10 is regarded as a presenter or a controller of a multimedia player). For example, they may be the wireless transmission setting, the setting of the utilization of power consumption, the wireless connection parameters setting, or the wireless broadcasting/advertising parameter setting.

Therefore, the action mode of the remote control apparatus 10 can be adjusted for the different connected host apparatuses 20 and various scenarios according to the scenario parameter table. For example, when the remote control apparatus 10 is a presenter, the power consumption is increased and the response time is decreased. Hence, the action mode of the remote control apparatus 10 can be adjusted according to the scenario parameter table, so that the user can acquire the best user experience in different scenarios.

Figure 3:
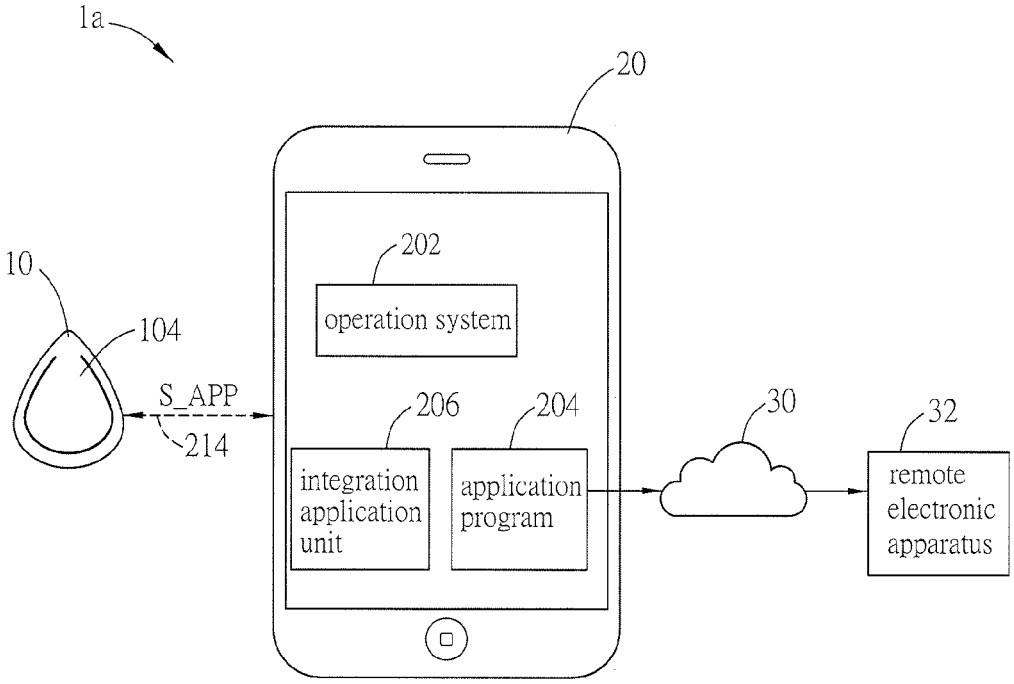
FIG. 3 is a schematic diagram of a control system of the second embodiment of the invention.

FIG. 3 is a schematic diagram of a control system of the second embodiment of the invention. As shown in FIG. 3, the control system 1 a provided by this embodiment includes a remote control apparatus 10, a host apparatus 20, a remote server 30 and a remote electronic apparatus 32. Likewise, the remote control apparatus 10 can be connected to the host apparatus 20. In this embodiment, when the user operates the operation unit 104 and the remote control apparatus 10 transmits the application control signal S_APP to the host apparatus 20 through the application connection 214, the integration application unit 206 can call the application program 204 according to the application control signal S_APP and make the application program 204 connected with the remote server 30 and control the remote electronic apparatus 32 through the remote server 30. In this embodiment, the remote electronic apparatus 32 can be a household appliance or a smart household control apparatus.

Figure 4:
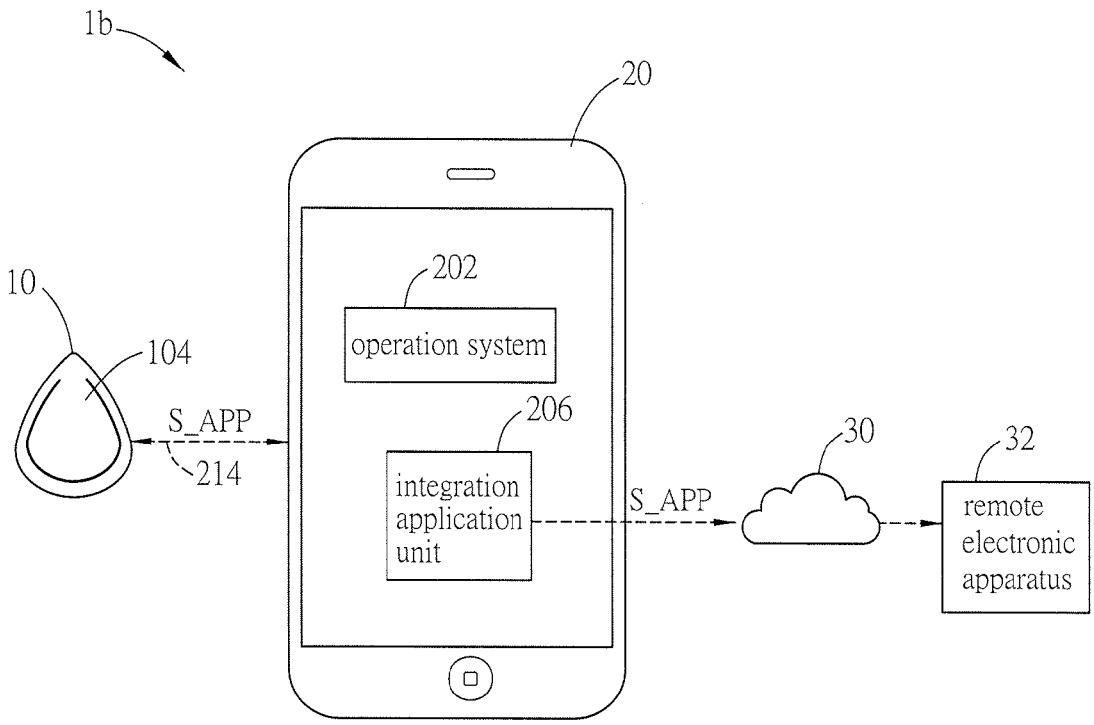
FIG. 4 is a schematic diagram of a control system of the third embodiment of the invention.

FIG. 4 is a schematic diagram of a control system of the third embodiment of the invention. As shown in FIG. 4, the control system 1*b* provided by this embodiment is the same as the case of FIG. 3, and it includes the remote control apparatus 10, the host apparatus 20, the remote server 30 and the remote electronic apparatus 32. The difference between them is that when the user operates the operation unit 104 to make the remote control apparatus 10 transmit the application control signal S_APP to the host apparatus 20 through the application connection 214 in this embodiment, the integration application unit 206 will directly transmit the application control signal S_APP to the remote server 30. In this embodiment, the remote server 30 can be configured with an application program (not shown). When the remote server 30 receives the application control signal S_APP, the said application program installed on the remote server 30 can control the remote electronic apparatus 32 according to the application control signal S_APP.

In some embodiments, the remote server 30 is not configured with the application program used to control the remote electronic apparatus 32, whereas the remote electronic apparatus 32 is configured with the application program (not shown). In these embodiments, when the remote server 30 receives the application control signal S_APP sent by the host apparatus 20, the remote server 30 will directly transfer it to the remote electronic apparatus 32 for calling the application program installed on the remote electronic apparatus 32 to control the operation of the remote electronic apparatus 32 or other remote electronic apparatuses 32.

In some embodiments, the remote electronic apparatus 32 can be connected to the remote server 30 by itself and acquire the application control signal S_APP that is transmitted to the remote server 30 by the host apparatus 20, for executing the corresponding operation.

The applications of the second and third embodiments are used to control the remote electronic apparatus 32, such as a smart appliance. For example, when the user wants to start the smart appliance at home (ex. turning on the light or the air conditioner) during the driving, the user needs to perform the complicated operation by the host apparatus of the smart mobile phone in the conventional art. The user needs to slide on the image displayed by the smart mobile phone to find the corresponding application program and then click to start the corresponding application program, and needs to perform the operation through the interface displayed on the screen of the smart mobile phone when the corresponding application program is started. Because the user needs to drive the car and perform such complicated operation at the same time, it is not only inconvenient but also the risk of the driving safety will be raised. However, in the above second and third embodiments, the user can directly operate the remote electronic apparatus 32 just by simply operating the remote control apparatus 10, such as shortly pressing the button for one time. Accordingly, the convenience of the user operating the remote electronic apparatus can be increased in this invention.

Figure 5:
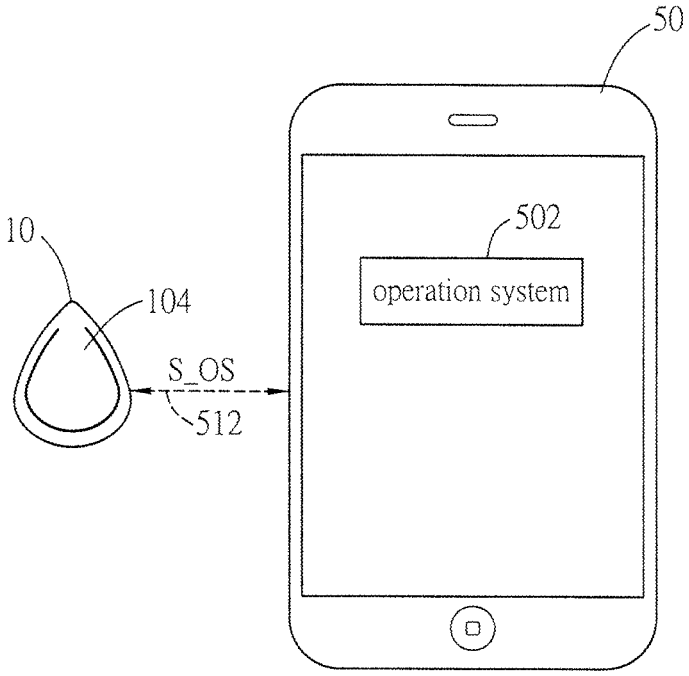
FIG. 5 is a schematic diagrams of a control system of the fourth embodiment of the invention.
Figure 6:
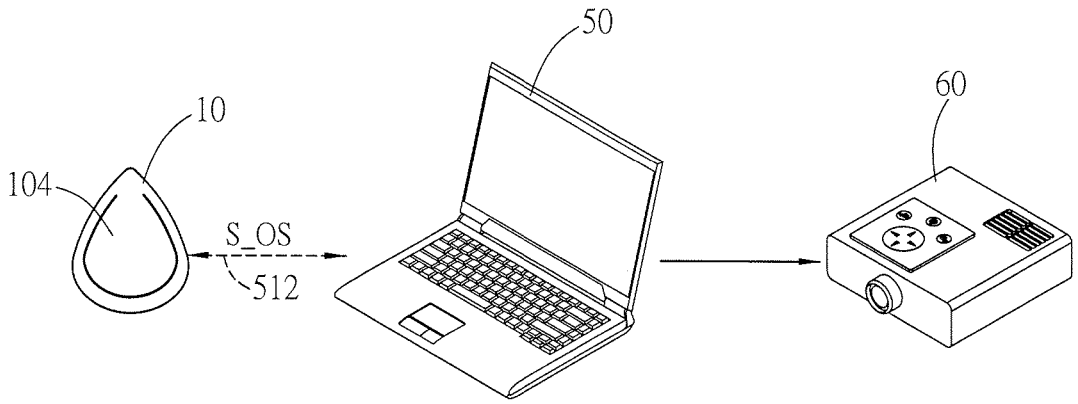
FIG. 6 is a schematic diagrams of a control system of the fourth embodiment of the invention.
Figure 7:
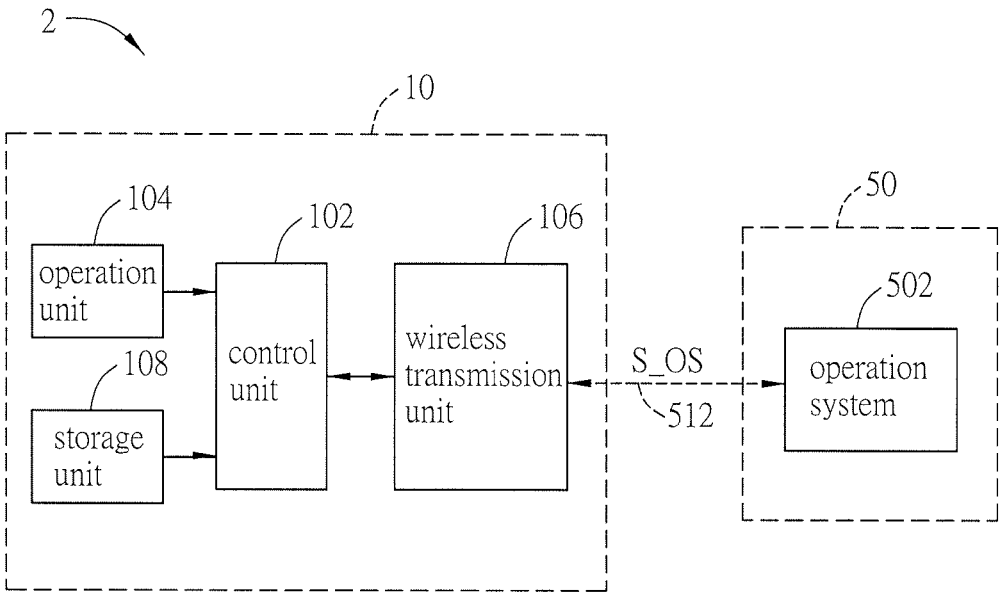
FIG. 7 is a schematic block diagram of the control system of the fourth embodiment of the invention.

FIGS. 5 and 6 are schematic diagrams of a control system of the fourth embodiment of the invention, and FIG. 7 is a schematic block diagram of the control system of the fourth embodiment of the invention. As shown in FIGS. 5 to 7, the components or apparatuses in the following embodiments have functions the same as or similar to the components or apparatuses in the above embodiments denoted by the same or similar number, so the related illustrations are omitted here for conciseness. The control system 2 provided by this embodiment includes the remote control apparatus 10 and the host apparatus 50. The host apparatus 50 can be the above-mentioned host apparatus 20 or other host apparatuses, such as a smart mobile phone, a tablet computer, a notebook computer, a tablet notebook computer, a wallet computer, a desktop computer or an industrial computer. However, the difference is that the host apparatus 50 is not configured with the above-mentioned integration application unit 206. Accordingly, the remote control apparatus 10 can't perform the authentication procedure with the host apparatus 50, so the remote control apparatus 10 will regard the host apparatus 50 as the host which is not configured with the integration application unit. In this embodiment, the host apparatus 50 which is not configured with the integration application unit is a notebook computer for example.

As shown in FIGS. 5 to 7, when the wireless transmission unit 106 is connected with the host apparatus 50, the wireless transmission unit 106 will build the operation system connection 512 with the operation system 502 of the host apparatus 50. In this embodiment, the storage unit 108 of the remote control apparatus 10 stores a first corresponding table, so that the control unit 102 acquires the permission for operating at least one function of the operation system 502 according to the first corresponding table. Moreover, the first corresponding table is the corresponding table pre-stored by the factory during the ex-factory, the remote control apparatus 10 can further include a second corresponding table provided for the user to perform the arrangement of the required function according to the preference, and the control unit 102 of the remote control apparatus 10 can acquire the permission for operating at least one function of the operation system 502 according to the first or second corresponding table. However, because the host apparatus 50 is not configured with the integration application unit 206, the control unit 102 won't acquire the permission for operating other application programs installed on the host apparatus 50 that is not configured with the integration application unit.

In this embodiment, when the operation unit 104 receives an operation mode, such as a short pressing, it is set to control a function of the operation system 502. Accordingly, when the control unit 102 determines that the operation unit 104 receives the corresponding operation mode, the control unit 102 will transmit an operation system control signal S_OS through the wireless transmission unit 106 and the operation system control signal S_OS is transmitted to the host apparatus 50 through the operation system connection 512. In this embodiment, the operation system connection 512 also can conform to the generic attribute profile (GATT).

When the host apparatus 50 receives the operation system control signal S_OS through the operation system connection 512, the operation system 502 will decode it and start and operate a function according to the operation system control signal S_OS. In this embodiment, the operation system control signal S_OS contains the instructions of controlling the presentation. Accordingly, in some scenario where, for example, the user connects the host apparatus 50 not configured with the integration application unit to the projector 60 for the presentation, the user just needs to shortly press the operation unit 104 for one time, so that the host apparatus 50 not configured with the integration application unit will make the projector 60 project the next page of the presentation. Therefore, even if the user uses the host apparatus 50 which the user is not acquainted with to perform the presentation, it doesn't require the complicated setting procedure to quickly connect the remote control apparatus 10 to the unacquainted host apparatus 50 for the control. Therefore, the performance of the presentation can be enhanced in this invention. Furthermore, in this invention, the remote control apparatus 10 can determine if the connected host apparatus 50 is configured with the integration application unit through the authentication procedure and can automatically choose the first corresponding table, the second corresponding table or the integration application corresponding table for performing the operations of different functions.

The presentation in the above description is given as an example to illustrate how the remote control apparatus 10 controls the host apparatus 50 that is not configured with the integration application unit, but this invention is not limited thereto. The user can arrange and set the second corresponding table to adjust the function of the remote control apparatus 10 controlling the host apparatus 50 that is not configured with the integration application unit. In other embodiments, the remote control apparatus 10 also can be used to control other functions of the operation system 502, such as playing the multimedia, controlling the volume and controlling the cursor's position.

Summarily, because the remote control apparatus of this invention can acquire the permission for operating at least one function of the operation system of the authentication host apparatus and the permission for operating the integration application unit, and can acquire the permission for operating at least one function of the operation system of the host apparatus that is not configured with the integration application unit, the user can trigger different events just by simply operating the remote control apparatus of this invention. Therefore, the convenience of controlling the host apparatus or even the remote electronic apparatus can be increased.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A remote control apparatus wirelessly connected with a host apparatus configured with an integration application unit, comprising:

a wireless transmission unit wirelessly connected with the host apparatus;

a control unit electrically connected with the wireless transmission unit, wherein the control unit authenticates the integration application unit and acquires a permission for operating at least one function of an operation system of the host apparatus;

an operation unit electrically connected with the control unit and receiving an operation mode, wherein the control unit generates a control signal according to the operation mode; wherein the control unit transmits the control signal to the host apparatus through the wireless transmission unit for choosing one of the operation system and the integration application unit to trigger at least one event according to the control signal;

a storage unit electrically connected with the control unit and pre-storing a first corresponding table, wherein the control unit generates the control signal according to the operation mode and the first corresponding table to control at least one function of the operation system; wherein the storage unit further comprises a second corresponding table, which can be set by a user, the control unit generates the control signal according to the operation mode and the second corresponding table to control at least one function of the operation system; and wherein triggering the at least one event comprises starting the function of the operation system of the host apparatus, calling an application program installed on the host apparatus, calling the application program to remotely control at least one remote electronic apparatus, calling the application program installed on the remote electronic apparatus to control the at least one remote electronic apparatus, or transmitting the control signal to a remote server and then making the at least one remote electronic apparatus connected with the remote server to acquire the control signal and execute a corresponding operation.

2. The remote control apparatus as recited in claim 1, wherein the storage unit further comprises at least one integration application corresponding table, which corresponds to the integration application unit and is also stored in the integration application unit, the control unit of the remote control apparatus authenticates the integration application unit and transmits the control signal to the host apparatus, and the integration application unit operates at least one function according to the control signal.

3. The remote control apparatus as recited in claim 1, further comprising: a storage unit electrically connected with the control unit and storing a result of the authentication performed by the control unit to the integration application unit.

4. The remote control apparatus as recited in claim 1, wherein the operation unit is at least one of a button, a gesture sensor, an infrared sensor, a temperature sensor, an ultraviolet sensor and a touch sensor.

5. The remote control apparatus as recited in claim 1, wherein the operation mode comprises a number of clicks, a short pressing, a long pressing, the combination of a short pressing and a long pressing, a click number, a click frequency, a duration of a continuous click, the combination of a long click and a short click, a gesture, a single-finger sliding, a multi-finger sliding or a direction of a sliding.

6. The remote control apparatus as recited in claim 1, wherein the wireless transmission unit is a Bluetooth transmission unit, a Bluetooth low energy transmission unit, a Zigbee transmission unit or an Ipv6 over Low power WPAN (6LoWPAN) transmission unit.

7. The remote control apparatus as recited in claim 1, wherein the storage unit further comprises a scenario parameter table, and the remote control apparatus adjusts its action mode according to the scenario parameter table.

8. A remote control apparatus wirelessly connected with a host apparatus, comprising:

a wireless transmission unit wirelessly connected with the host apparatus;

a control unit electrically connected with the wireless transmission unit and acquiring a permission for operating at least one function of an operation system of the host apparatus;

an operation unit electrically connected with the control unit and receiving an operation mode, wherein the control unit generates a control signal according to the operation mode;

a storage unit electrically connected with the control unit and pre-storing a first corresponding table, wherein the control unit transmits the control signal to the host apparatus according to the first corresponding table through the wireless transmission unit to operate the at least one function;

wherein the first corresponding table is a predetermined corresponding table, and the control unit generates the control signal according to the operation mode and the first corresponding table to control at least one function of the operation system;

wherein the storage unit further comprises a second corresponding table, which can be set by a user, the control unit generates the control signal according to the operation mode and the second corresponding table to control at least one function of the operation system; and wherein operating the at least one function comprises starting the function of the operation system of the host apparatus, calling an application program installed on the host apparatus, calling the application program to remotely control at least one remote electronic apparatus, calling the application program installed on the remote electronic apparatus to control the at least one remote electronic apparatus, or transmitting the control signal to a remote server and then making the at least one remote electronic apparatus connected with the remote server to acquire the control signal and execute a corresponding operation.

9. The remote control apparatus as recited in claim 8, wherein the host apparatus is configured with an integration application unit, the storage unit further comprises at least one integration application corresponding table, which corresponds to the integration application unit and is also stored in the integration application unit, the control unit of the remote control apparatus authenticates the integration application unit and transmits the control signal to the host apparatus, and the integration application unit operates at least one function according to the control signal.

10. The remote control apparatus as recited in claim 8, wherein operating the at least one function comprises starting the function of the operation system of the host apparatus, calling an application program installed on the host apparatus, calling the application program to remotely control at least one remote electronic apparatus, calling the application program installed on the remote electronic apparatus to control the at least one remote electronic apparatus, or transmitting the control signal to a remote server and then making the at least one remote electronic apparatus connected with the remote server to acquire the control signal and execute a corresponding operation.

11. The remote control apparatus as recited in claim 8, wherein the operation unit is at least one of a button, a gesture sensor, an infrared sensor, a temperature sensor, an ultraviolet sensor and a touch sensor.

12. The remote control apparatus as recited in claim 8, wherein the operation mode comprises a number of clicks, a short pressing, a long pressing, the combination of a short pressing and a long pressing, a click number, a click frequency, a duration of a continuous click, the combination of a tong click and a short click, a gesture, a single-finger sliding, a multi-finger sliding or a direction of a sliding.

13. The remote control apparatus as recited in claim 8, wherein the wireless transmission unit is a Bluetooth transmission unit, a Bluetooth low energy transmission unit, a Zigbee transmission unit or an Ipv6 over Low power WPAN (6LoWPAN) transmission unit.

14. The remote control apparatus as recited in claim 8, wherein the storage unit further comprises a scenario parameter table, and the remote control apparatus adjusts its action mode according to the scenario parameter table.

* * * * *